US005871615A

United States Patent [19]

Harris

[11] Patent Number: 5,871,615

[45] Date of Patent: Feb. 16, 1999

[54] METHOD FOR THE MANUFACTURE OF SECURITY PAPER

[75] Inventor: Colin Austin Harris, Ivybridge, England

[73] Assignee: The Wiggins Teape Group Limited, England

[21] Appl. No.: 478,017

[22] Filed: Jun. 7, 1995

[30] Foreign Application Priority Data

Jun. 14, 1994 [GB] United Kingdom ..... 9411868

[51] Int. Cl.[6] ..... D21F 11/00; B41M 3/10

[52] U.S. Cl. ..... 162/140; 162/110; 162/117; 283/113; 283/72; 283/83

[58] Field of Search ..... 162/740, 117, 162/110, 116, 103, 134; 283/93, 72, 98, 99, 113, 83, 114

[56] References Cited

U.S. PATENT DOCUMENTS

| | | | |
|---|---|---|---|
| 1,281,951 | 10/1918 | Harper | 162/140 X |
| 1,687,140 | 10/1928 | Player | 162/140 X |
| 4,033,059 | 7/1977 | Hutton et al. | 40/137 |
| 4,216,055 | 8/1980 | Watanabe et al. | 162/117 |
| 4,715,623 | 12/1987 | Roule et al. . | |
| 4,720,325 | 1/1988 | Rausing et al. | 162/110 |

FOREIGN PATENT DOCUMENTS

| | | |
|---|---|---|
| 1019012 | 10/1977 | Canada . |
| 194042A | 9/1986 | European Pat. Off. . |
| 581414A | 2/1994 | European Pat. Off. . |
| 215302 | 7/1924 | United Kingdom . |
| 413834 | 7/1934 | United Kingdom . |
| 458758 | 12/1936 | United Kingdom . |
| 596693 | 1/1948 | United Kingdom . |
| 627759 | 8/1949 | United Kingdom . |
| 836615 | 6/1960 | United Kingdom . |
| 91704 | 1/1963 | United Kingdom . |
| 1063672 | 3/1967 | United Kingdom . |
| 119398 | 5/1970 | United Kingdom . |
| 1447933 | 9/1976 | United Kingdom . |
| 2149827B | 6/1985 | United Kingdom . |
| 2270931 | 3/1994 | United Kingdom . |
| WO90/02658 | 3/1990 | WIPO . |
| WO92/11413 | 7/1992 | WIPO . |
| WO94/08089 | 4/1994 | WIPO . |

OTHER PUBLICATIONS

Norris, F.H. "Paper and Paper Making", p. 163, 1952.

"Watermarks, A Brief History and Survey of the Techniques", last page (excluding glossary and acknowledgements), third paragraph from the end, 1973.

Leach, R.H. et al, "The Printing Ink Manual", Fifth Edition 1993, pp. 40 and 41.

"Packaging in the Making", trade literature of Sandon, Runcorn, United Kingdom, published 1991.

"Zedco Rapide", trade literature of Zedco, Hersham, United Kingdom.

*Primary Examiner*—Stanley S. Silverman
*Assistant Examiner*—Jose S. Fortuna
*Attorney, Agent, or Firm*—Burns, Doane, Swecker & Mathis, L.L.P.

[57] ABSTRACT

Security paper carries an intricate tactile surface profile pattern which has been imparted to the paper during its manufacture, at a stage after initial de-watering but before final drying, by passing the paper through a nip between a forming surface corresponding to the desired pattern and a backing surface. The tactile pattern is of excellent durability, and its intricacy offers a high degree of security. The tactile pattern is visible when viewed under low angle light, which facilitates verification or authentication of security documents made using the patterned paper.

7 Claims, 2 Drawing Sheets x3

METHOD FOR THE MANUFACTURE OF SECURITY PAPER

BACKGROUND OF THE INVENTION

This invention relates to security paper, i.e. paper which is resistant to counterfeiting or other attempts at fraudulent imitation and which is suitable for use in the production of security documents.

By a "security paper" or "security document" is meant any paper or document having a value such as to render it potentially liable to attempts at counterfeiting. Typical examples of such papers or documents are papers for use in passports; banknotes; cheques; travellers cheques; money orders; bankers drafts; bearer bonds; share certificates and other certificates; stamps; postal orders; identity documents; registration documents, driving licences, vehicle road tax licences and other licences or permits; electoral papers; savings or bank account passbooks; lottery tickets; admission tickets; travel tickets; vouchers; coupons; tokens; and shipping and other transport documents.

Papers for use in labels or distinctive packaging may also be subject to counterfeiting, particularly if they bear a manufacturer's name and/or a brand name. Considerable publicity has been given in recent years to the problems of illegal marketing of cheap copies of branded goods, for example car brake pads, and prestigious brands of wristwatch or clothing, and of illegal copying of pre-recorded music cassettes, records or videotapes or of computer programs. The copies are liable to be packaged and branded in much the same way as genuine goods from an original or authorised manufacturer. Thus the use of verifiable paper in the labels and/or packaging of the goods provides a means of checking the authenticity of branded goods. Verifiable label or packaging paper is therefore also within the ambit of the term "security paper" as used in this specification.

High security documents, such as passports and banknotes, often carry a tactilely-detectable surface profile pattern or design (hereafter referred to simply as a "tactile pattern") which is imparted to selected areas of the finished paper at the printing stage. The tactile effect can be produced by embossing, or by the use of special inks which stand proud of the paper even after drying, or a combination of embossing and special inks. The tactile pattern enables the document to be partially authenticated by touch, in that a document with no such selective tactile pattern is immediately revealed as counterfeit. An example of the use of a selective tactile security pattern is the internal end paper for UK-issued passports. The tactile pattern enables inspecting officers quickly to verify the document by touch.

Conventional dry embossed patterns suffer from the drawbacks that they increase production costs at the printing stage, and that they can wear away in use. The intricacy of the pattern applied, and thus the level of security obtainable, is also limited when the pattern is produced by embossing previously formed and dried paper.

It is an object of the invention to overcome the drawbacks just described.

It is known to produce a surface texture on a still wet web of paper on the papermachine before the web has been dried. Such textures may be applied by means of the press felts ("felt marking") or by embossing rolls or belts, see for example British Patent Application No. 2270931A. However such textures have been applied over the entire surface of the paper and are relatively simple and lacking in depth and/or fine detail. It is also known to "rubber mark" papers in the press section of the papermachine by means of rubber stereos mounted on one or both of a pair of cooperating press rolls. Such marking is usually used to apply a brand name, manufacturer's name or a logo, i.e. relatively simple designs.

SUMMARY OF THE INVENTION

We have now discovered that wet embossing texturing and marking technology, as described above and known per se, can be used to provide remarkably improved tactile patterns in security papers. More particularly, we have found that patterns of surprising intricacy and depth can be imparted to paper by wet embossing during the production operation and before the paper has been fully dried. The patterns imparted are of excellent durability, and in view of their intricacy, can offer a high degree of security, or distinctiveness. A further benefit is that the patterns imparted can be made to be visible when viewed under low angle light. This facilitates verification or authentication of security documents made using the patterned paper.

Accordingly, the present invention provides, in a first aspect, security paper carrying an intricate tactile surface profile pattern which has been imparted to the paper during its manufacture, at a stage after initial de-watering but before final drying, by passing the paper through a nip between a forming surface corresponding to the desired pattern and a backing surface.

In a second aspect, the present invention provides a method of producing security paper carrying an intricate tactile surface profile pattern, comprising the step of passing an initially de-watered but not yet fully-dried paper web through a nip between a forming surface corresponding to the desired pattern and a backing surface, thereby to impart the intricate tactile surface profile pattern to the surface of the web, prior to drying the web in conventional manner.

The invention also extends to security documents made using the present security paper.

Figure 1:
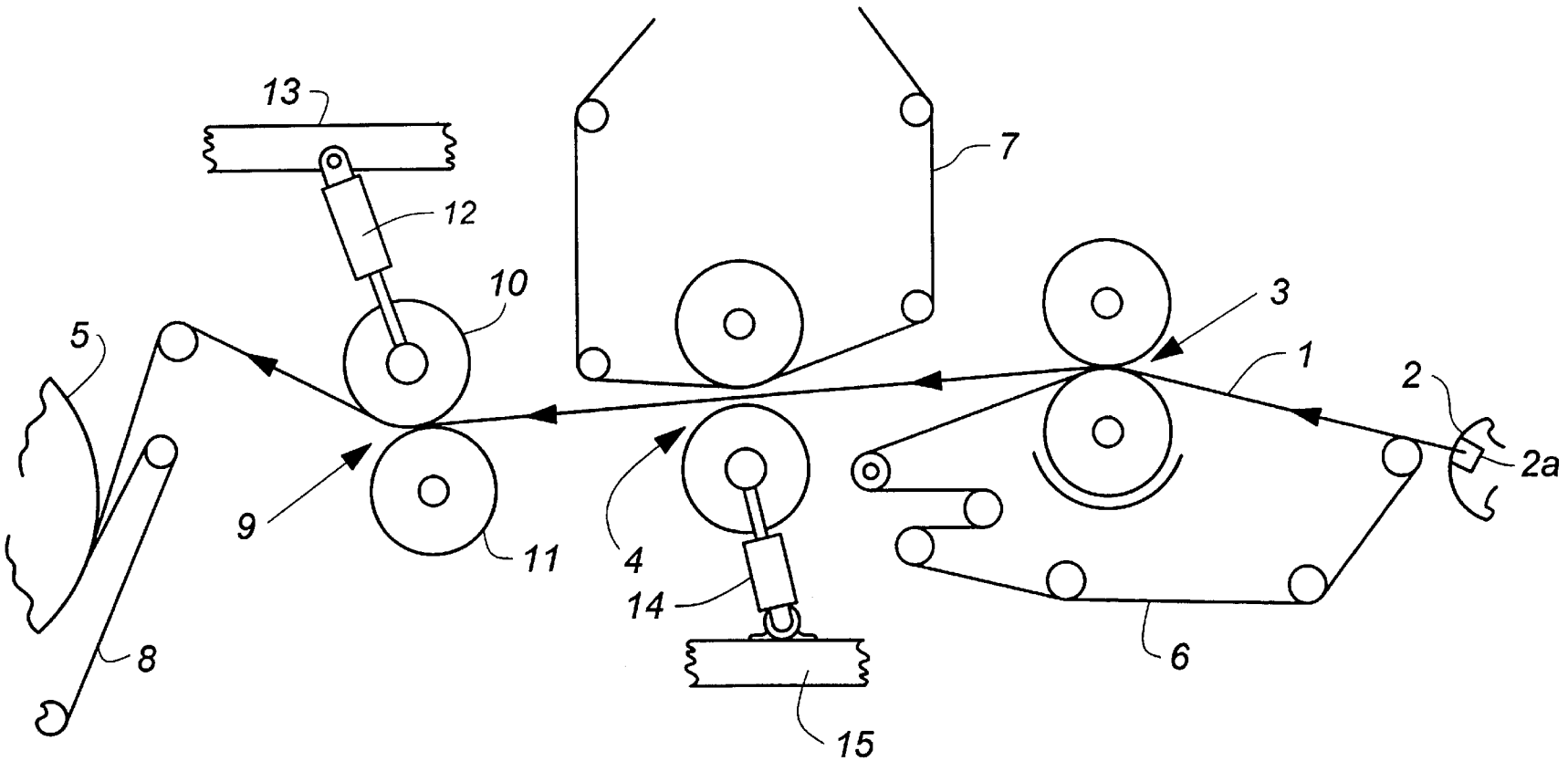
FIG. 1 is a diagrammatic side view of a papermachine press section, with a roll nip installed in the press section for imparting an intricate tactile security pattern.

The term "paper" in this specification extends to heavyweight paper products of the kind often referred to in the paper industry as "boards".

It will be appreciated that the present invention eliminates the need for a separate embossing operation at a subsequent printing stage, as well as providing a tactile pattern of enhanced durability and intricacy compared with prior art dry embossing procedures. The tactile pattern is normally applied only to selected areas of the paper, although it could in principle be applied over the entire area of the paper. The tactile pattern can if desired incorporate indications of origin in the form of logos, devices or words, especially trade marks or company names, which can be an important commercial benefit.

Turning now to the detail of the process for making the present security paper, the forming and backing surfaces are preferably the surfaces of respective rolls which together form a nip. In principle however, one or both of the forming and backing surfaces could be provided by cooperating belts or other forming means. The forming surface nip which imparts the pattern is preferably positioned in the press section of the papermachine, desirably just after the last press, where the moisture content of the web is such that the web readily takes up the desired pattern. Subsequent drying of the web by passage round heated drying cylinders then "fixes" the pattern in the paper, making it permanent, more durable and more sharply defined, and potentially, therefore, more intricate than a corresponding pattern embossed into a fully-dried paper.

The papermachine can be of the Fourdrinier type or of the cylinder mould type as conventionally used, for example, for banknote production.

The surface-patterned roll which constitutes the preferred forming surface is preferably a rubber roll, typically of 0.25 to 0.35 m diameter, and the pattern is produced by, for example, laser engraving techniques, known in themselves (see for example British Patent Application No. 2 270 931A, referred to earlier). Laser-engraved rolls are obtainable from, for example, Sandon Flexographic Printing Rollers Limited, of Runcorn, Great Britain, and Midwest Rubber Plate Co., Inc. of Menasha, Wis., U.S.A.

The rubber roll is typically of the order of 65° to 95° Shore hardness, and the forming surface typically has a maximum peak to valley dimension of the order of 1 to 1.5 mm. The backing roll is also preferably of rubber and of similar diameter and hardness as the forming surface roll. The nip pressure need only be modest, say of the order of 25 to 30 kg/linear cm, since the high moisture content of the web ensures that it is readily deformable. Typically this moisture content is in the range 50 to 65%, preferably 60 to 65%, the pressure applied in the press section being selected so as to achieve the moisture content desired. Use of rubber rolls and process conditions as just described typically gives rise to a pattern in the paper in which the maximum peak to valley dimension is of the order of 45 to 70 $\mu$m.

The two rolls forming the nip preferably extend across the full width of the web, even if it is desired to impart the pattern over only part of the width of the web.

The invention enables an intricate tactile security pattern to be applied to one or both surfaces of the web. If the latter, then both rolls of the nip have a forming surface, but the juxtaposition and drive mechanism of the rolls are such that the forming areas of the surface of one roll should bear against smooth areas of the cooperating backing roll.

The tactile security pattern imparted to the chosen selected areas of the paper web can vary widely. A particularly useful example is a repeating strip pattern which is either continuous or discontinuous. Alternatively, the pattern can be positioned so as to form a border in the finished document. A watermark can also be present in the paper, and for extra security or distinctiveness, can be located at a particular relative position to, or precise spacing from, the tactile pattern (say a spacing controlled to±5 mm). The tactile pattern in such a case is said to be "pre-located" in relation to the watermark. The tactile pattern can also be prelocated so as to be at a pre-determined desired spacing from the edge of the final document.

The tactile pattern can be subsequently printed using conventional methods such as litho, gravure etc. This facilitates further enhancement of the security of the paper, for example, by the application of a fluorescent ink to the surface of the paper carrying the tactile pattern. The high points of detail on the tactile pattern can be passed into contact with an ink roller carrying the fluorescent ink, leaving the low points unaffected. When the ink is dried and the paper is viewed under UV light, the outline of the image can be clearly seen. This additional security feature can be applied in a cost-effective way on the papermachine after the paper has been dried, at any convenient location prior to reel-up. Visible or other types of ink can be applied instead of or in addition to the fluorescent ink.

In order to enable the invention to be more readily understood, reference will now be made, by way of example only, to the accompanying drawings, in which:

Referring first to FIG. 1, a coherent but still wet paper web 1 emerges through a suction box 2*a* in a couch roll 2 (only partly shown) at the end of the wire section of a Fourdrinier papermachine. The web then passes through first and second wet presses generally indicated as 3 and 4 respectively and round a guide roller (unreferenced) to the first drying cylinder 5 (only partly shown) of the dryer section of the papermachine. The presses 3 and 4 each include endless wet felts 6 and 7 respectively running round guide rollers (unreferenced). A collection tray (unreferenced) is positioned beneath the press 3. The drying cylinder 5 is associated with a dry felt 8 which holds the web in close contact with the drying cylinder.

A pair of nip rolls 9 is positioned in the web path between the second wet press 4 and the first drying cylinder 5. The upper roll 10 has a laser-engraved rubber forming surface whereas the lower backing roll 11 has a plane rubber surface. The roll 11 is driven. The pressure in the nip is controlled by a hydraulic cylinder 12 supported by a beam 13. The moisture content of the web as it passes between the rolls 10 and 11 is controllable primarily by adjustment of the pressure in the second wet press by means of a hydraulic cylinder 14 supported by a beam 15. As illustrated, the second wet press is open to avoid lowering the web moisture content excessively.

Figure 2:
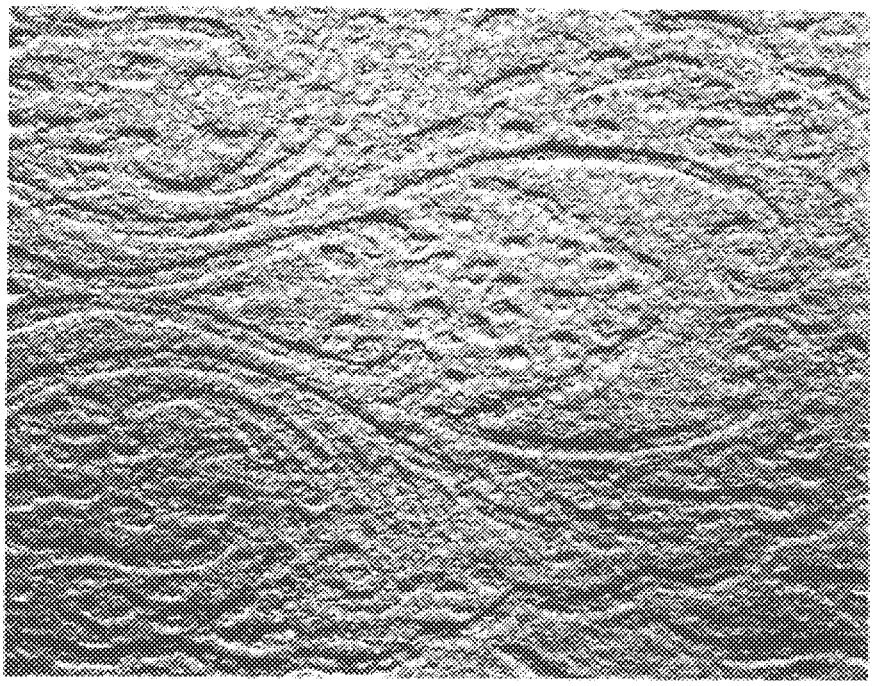
FIG. 2 is a photograph on a three-times enlarged scale of part of an intricate tactile security pattern which can be produced by the present method.

A 100 g $m^{-2}$ security paper was prepared from a 60% hardwood/40% softwood pulp furnish using the apparatus just described, with a machine speed of 110 m $min^{-1}$. The rubber covering of the forming surface roll 10 had a hardness of 85° Shore, and the maximum peak to valley dimension of the forming surface was 1.5 mm. The nip pressure was about 25 kg/linear cm and the moisture content of the web at the roll nip was around 60–65% by weight. A well-defined intricate tactile security pattern was present in the paper once dried, with largest measured peak to valley dimensions of 59 and 60 microns. The pattern was readily apparent to the touch and could be seen easily when viewed under low-angle light, as FIG. 2 shows clearly.

In an alternative arrangement, a cylinder mould forming section is used instead of a Fourdrinier wire.

I claim:

1. A method of producing security paper carrying an intricate tactile surface profile pattern, comprising the step of passing an initially de-watered, but not yet fully-dried paper web through a nip between a forming surface corresponding to the desired pattern and a backing surface, thereby to impart the intricate tactile surface profile pattern to the surface of the web, prior to drying the web in conventional manner.

2. A process as claimed in claim 1, wherein the forming and backing surfaces are the surfaces of respective rolls which together form the nip.

3. A process as claimed in claim 2 wherein the forming surface is an engraved rubber surface with a maximum peak to valley dimension of the order of 1 to 1.5 mm.

4. A process as claimed in claim 3, wherein the backing roll surface is also of rubber, and the hardness of the rubber in both the forming and backing surfaces is of the order of 65° to 95° Shore.

5. A process as claimed in claim 4, wherein the nip pressure is of the order of 25 to 30 kg/linear cm and the web moisture content of the web as the web enters the nip is in the range 50 to 65% by weight.

6. A process as claimed in claim 2 wherein the forming surface is a laser-engraved rubber surface.

7. A method for producing a security paper carrying an intricate tactile surface profile pattern which has been imparted to the paper during its manufacture, at a stare after initial de-watering but before final drying, said method including steps of initial de-watering and final drying and further comprising passing the paper through a nip between a forming surface corresponding to the desired pattern and a backing surface.

* * * * *